US008300837B2

(12) United States Patent
Shmunk

(10) Patent No.: US 8,300,837 B2
(45) Date of Patent: Oct. 30, 2012

(54) SYSTEM AND METHOD FOR COMPENSATING MEMORYLESS NON-LINEAR DISTORTION OF AN AUDIO TRANSDUCER

(75) Inventor: Dmitry V. Shmunk, Novosibirsk (RU)

(73) Assignee: DTS, Inc., Calabasas, CA (US)

( * ) Notice: Subject to any disclaimer, the term of this patent is extended or adjusted under 35 U.S.C. 154(b) by 1294 days.

(21) Appl. No.: 11/583,190

(22) Filed: Oct. 18, 2006

(65) Prior Publication Data

US 2008/0101619 A1 May 1, 2008

(51) Int. Cl.
*H04R 29/00* (2006.01)
*H04R 3/00* (2006.01)

(52) U.S. Cl. ..... 381/59; 381/96

(58) Field of Classification Search ..... 381/55, 381/59, 96, 97, 111, 117
See application file for complete search history.

(56) References Cited

U.S. PATENT DOCUMENTS 5,438,625 A 8/1995 Klippel
5,542,001 A * 7/1996 Reiffin ..... 381/96
2005/0195993 A1* 9/2005 Kwon et al. ..... 381/102

FOREIGN PATENT DOCUMENTS

EP 0508392 A2 10/1992

OTHER PUBLICATIONS

Klippel et al, "Loudspeaker Nonlinearities- Causes, Parameters, Symptoms", AES Oct. 7-10, 2005.
Bard et al, "Compensation of Nonlinearities of Horn Loudspeakers", AES Oct. 7-10, 2005.
Klippel, Wolfgang: "The mirror filter—a new basis for reducing nonlinear distortion and equalizing response in woofer systems" J. Audio Eng. Soc., vol. 40, Sep. 30, 1992.
Klippel, Wolfgang: "Tutorial: Loudspeaker nonlinearities—Causes, parameters, symptoms" Journal of Audio Engineering Society, vol. 54, no. 10, Oct. 1, 2006, pp. 907-939.
Anderson, M.R.: Compensation of nonlinearities in Transducers [online] Feb. 25, 2005, pp. I-XVI, 1-85, Technical University of Denmark.
European search report issued in corresponding European patent application No. 07838787.5; Filed Sep. 25, 2007.

* cited by examiner

*Primary Examiner* — Ping Lee
(74) *Attorney, Agent, or Firm* — William Johnson; Gaurav Mohindra; Joel Stoffregen

(57) ABSTRACT

A low-cost, real-time solution is presented for compensating memoryless non-linear distortion in an audio transducer. The playback audio system estimates signal amplitude and velocity, looks up a scale factor from a look-up table (LUT) for the defined pair (amplitude, velocity) (or computes the scale factor for a polynomial approximation to the LUT), and applies the scale factor to the signal amplitude. The scale factor is an estimate of the transducer's memoryless nonlinear distortion at a point in its phase plane given by (amplitude, velocity), which is found by applying a test signal having a known signal amplitude and velocity to the transducer, measuring a recorded signal amplitude and setting the scale factor equal to the ratio of the test signal amplitude to the recorded signal amplitude. Scaling can be used to either pre- or post-compensate the audio signal depending on the audio transducer.

26 Claims, 9 Drawing Sheets

SYSTEM AND METHOD FOR COMPENSATING MEMORYLESS NON-LINEAR DISTORTION OF AN AUDIO TRANSDUCER

BACKGROUND OF THE INVENTION

1. Field of the Invention

This invention relates to audio transducer compensation, and more particularly to a method of compensating non-linear distortion of an audio transducer such as a speaker, earphone or microphone.

2. Description of the Related Art

Audio transducers preferably exhibit a uniform and predictable input/output (I/O) response characteristic. In a speaker, the analog audio signal coupled to the input of a speaker is what is ideally provided at the ear of the listener. In reality, the audio signal that reaches the listener's ear is the original audio signal plus some distortion caused by the speaker itself (e.g., its construction and the interaction of the components within it) and by the listening environment (e.g., the location of the listener, the acoustic characteristics of the room, etc) in which the audio signal must travel to reach the listener's ear. There are many techniques performed during the manufacture of the speaker to minimize the distortion caused by the speaker itself so as to provide the desired speaker response. In addition, there are techniques for mechanically hand-tuning the speaker to further reduce distortion.

Distortion includes both linear and non-linear components. Non-linear distortion such as "clipping" is a function of the amplitude of the input audio signal whereas linear distortion is not. Klippel et al, 'Loudspeaker Nonlinearities—Causes, Parameters, Symptoms' AES Oct. 7-10, 2005 describes the relationship between non-linear distortion measurement and nonlinearities which are the physical causes for signal distortion in speakers and other transducers.

There are many approaches to solve the linear part of the problem. The simplest method is an equalizer that provides a bank of bandpass filters with independent gain control. Techniques for compensating non-linear distortion are less developed.

Bard et al "Compensation of nonlinearities of horn loudspeakers", AES Oct. 7-10, 2005 uses an inverse transform based on frequency-domain Volterra kernels to estimate the nonlinearity of the speaker. The inversion is obtained by analytically calculating the inverted Volterra kernels from forward frequency domain kernels. This approach is good for stationary signals (e.g. a set of sinusoids) but significant nonlinearity may occur in transient non-stationary regions of the audio signal.

SUMMARY OF THE INVENTION

The present invention provides a low-cost, real-time solution for compensating memoryless non-linear distortion in an audio transducer.

This is accomplished with an audio system that estimates signal amplitude and velocity of an audio signal, looks up a scale factor from a look-up table (LUT) for the defined pair (amplitude, velocity), and applies the scale factor to the signal amplitude. The scale factor is an estimate of the transducer's nonlinear distortion at a point in its phase plane given by (amplitude, velocity). The transducer's nonlinear distortion over the phase plane is found by applying a test signal having a known signal amplitude and velocity to the transducer, measuring a recorded signal amplitude and setting the scale factor equal to the ratio of the test signal amplitude to the recorded signal amplitude. The test signal(s) should have amplitudes and velocities that span the phase plane. This approach assumes that the sources of nonlinear distortion are 'memoryless', which for most transducers is a reasonably accurate assumption. Scaling can be used to either pre- or post-compensate the audio signal depending on the audio transducer. The compensated audio signal will exhibit lower harmonic distortion (HD) and intermodulation distortion (IMD), which are the typical specifications for nonlinear distortion of a speaker.

These and other features and advantages of the invention will be apparent to those skilled in the art from the following detailed description of preferred embodiments, taken together with the accompanying drawings, in which:

DETAILED DESCRIPTION OF THE INVENTION

The present invention describes a low-cost, real-time solution for compensating non-linear distortion in an audio transducer such as a speaker, earphone or microphone. As used herein, the term "audio transducer" refers to any device that is actuated by power from one system and supplies power in another form to another system in which one form of the power is electrical and the other is acoustic or electrical, and which reproduces an audio signal. The transducer may be an output transducer such as a speaker or earphone or an input transducer such as a microphone. An exemplary embodiment of the invention will be now be described for a loudspeaker that converts an electrical input audio signal into an audible acoustic signal.

A reading of Klippel's paper led us to the observation that the primary non-linear distortion that contributes to HD and IMD is 'memoryless'. The physical causes of this distortion can be described entirely by a $1^{st}$ order approximation of the potential and kinetic energy of the audio transducer. To a good approximation, the potential and kinetic energy, hence the memoryless non-linear distortion can be uniquely described by the signal amplitude and signal velocity, respectively.

Figure 1:
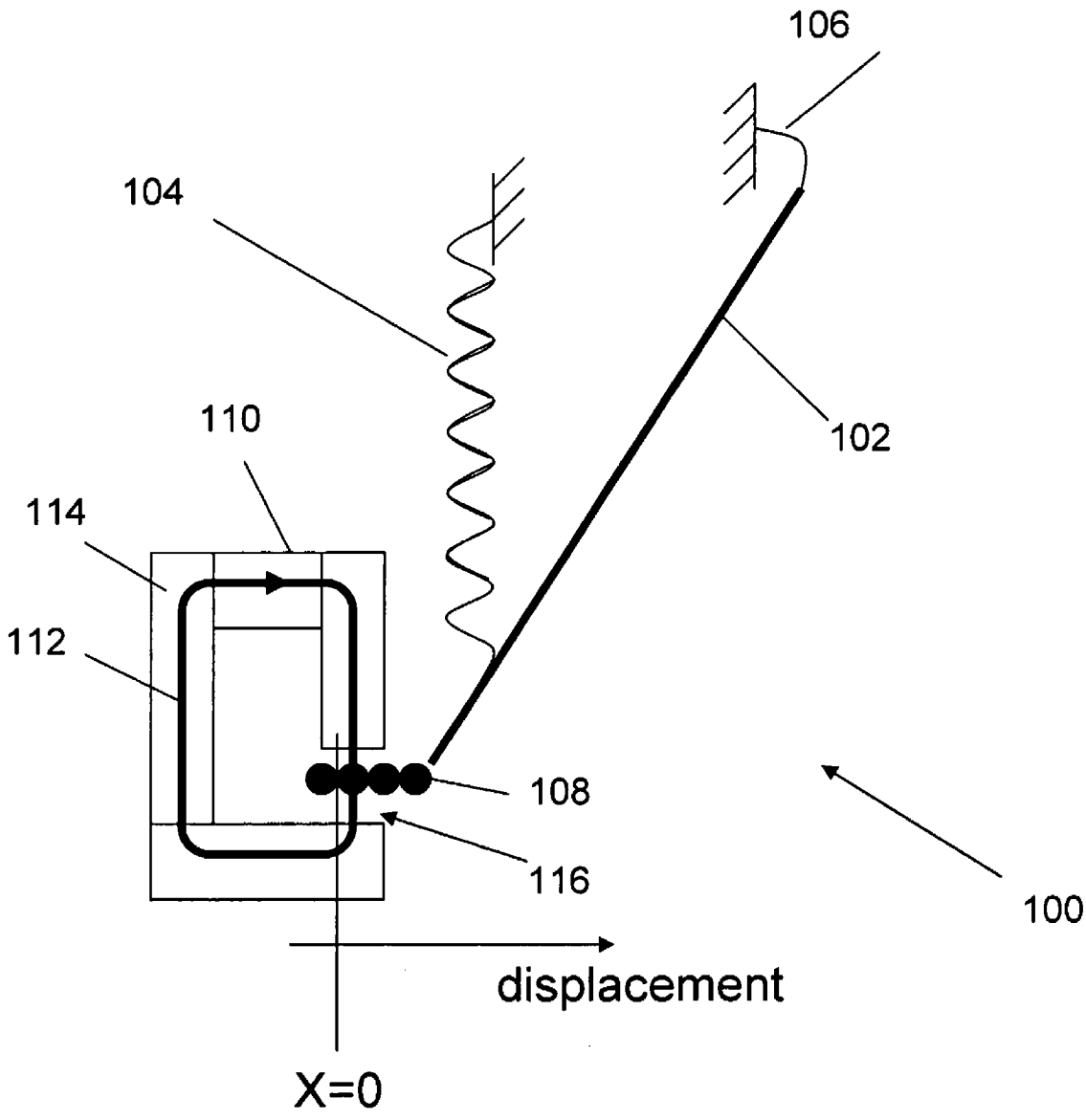
FIG. 1 is a schematic diagram of an audio transducer.
Figure 2A:
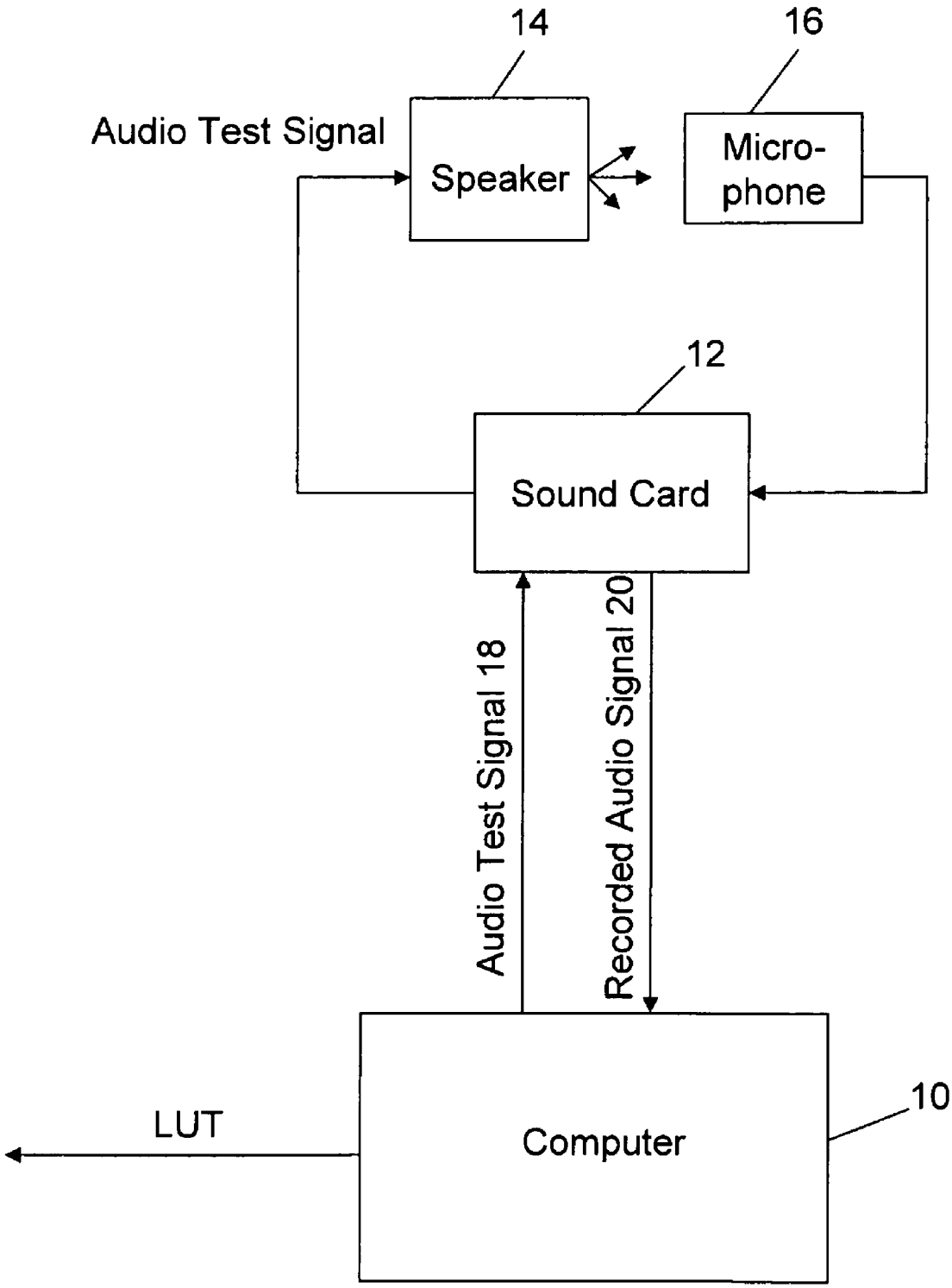
FIGS. 2*a* and 2*b* are block and flow diagrams for computing a phase plane LUT for pre-compensating an audio signal for playback on an audio transducer.
Figure 2B:
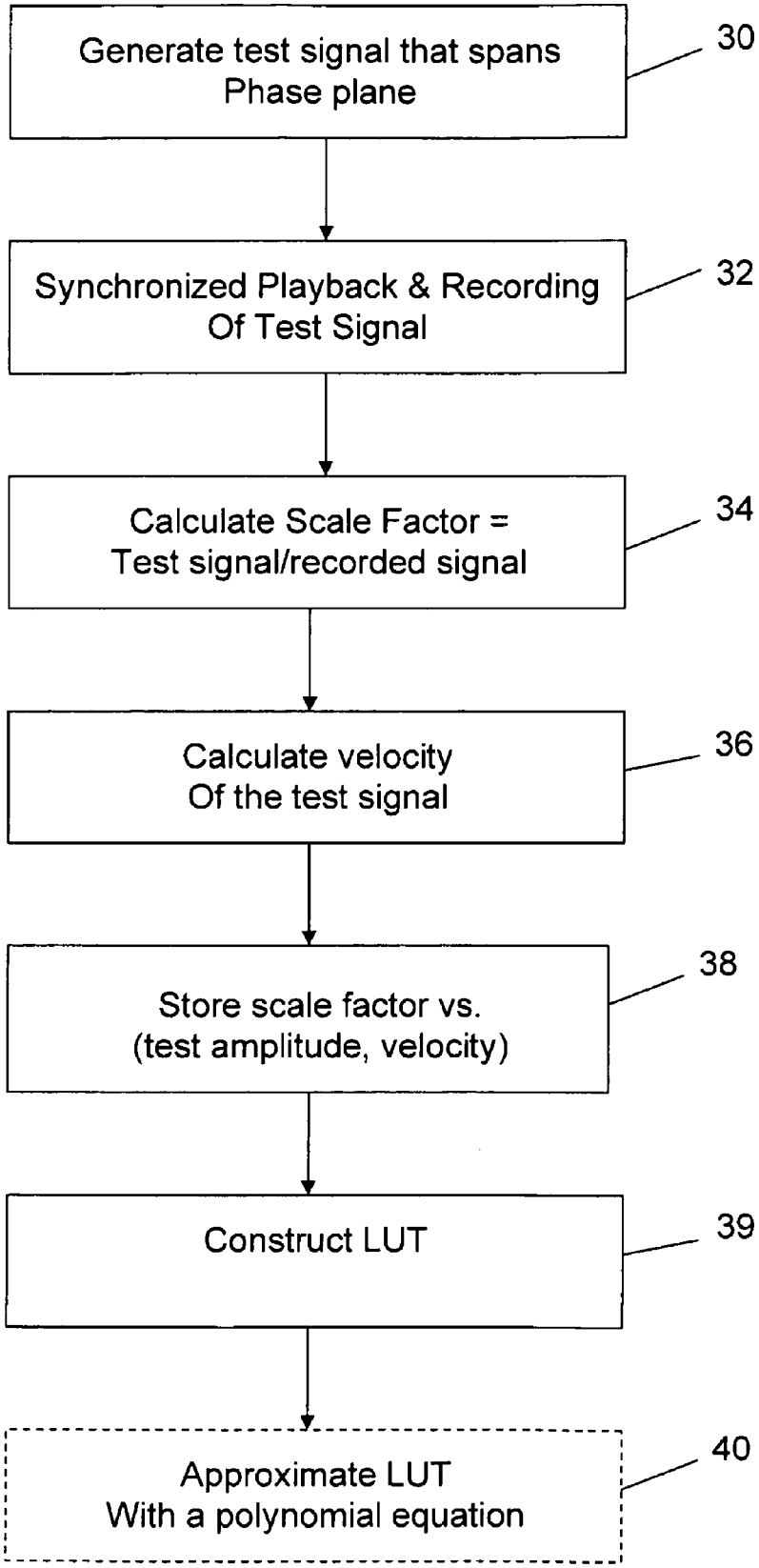

As shown in FIG. 1, an audio speaker 100 includes a diaphragm 102 that pushes the air to create sound waves. The diaphragm is suspended on a spider 104 and a surround 106, which are connected to a speaker frame (not shown). Voice coil 108 is connected to the diaphragm and receives electrical current (input signal). The diaphragm movement happens through interaction 112 of the magnetic field of a permanent magnet 110 with magnetic field of the coil 108. Permanent magnet is typically connected to the metallic construction 114 in the speaker to provide proper configuration of the magnetic field and geometry of the gap 116 where voice coil is moving.

The total energy of the speaker is given by:

$$E=E_p+E_k$$

Where:

$$E_p = \frac{kx^2}{2} + L\frac{I^2}{2} \text{-potential energy}$$

$$E_k = \frac{mv^2}{2} \text{-kinetic energy}$$

$k$-stiffness of the suspension (surround + spider)

$x$-displacement of the diaphragm $L$-inductance of the coil $I$-current through coil, proportional to the signal amplitude $m$-mass of the diaphragm $v$-velocity of the diaphragm These simplified formulas, which do not take into account that speaker is constructed from many parts or the interdependence of the parameters (k, I, L , . . . ) that would require higher order nonlinear terms to fully describe the system, provide a good approximation of the system and the causes of the memoryless non-linear distortion.

The observation that the non-linear distortion is to a large extent 'memoryless' and that the audio transducer energy can be represented to a good approximation by the signal amplitude and velocity, allows for a low-cost, real-time solution for compensating non-linear distortion in an audio transducer. An audio playback system estimates signal amplitude and velocity, looks up the closest scale factor(s) from a look-up table (LUT) for the measured pair (amplitude, velocity), preferably interpolates to a scale factor for the measured pair, and applies the scale factor to the signal amplitude. The scale factor is an estimate of the transducer's nonlinear distortion at a point in its phase plane given by amplitude, velocity. The transducer's nonlinear distortion over the phase plane is found by applying a test signal having a known signal amplitude and velocity to the transducer, measuring a recorded signal amplitude and setting the scale factor equal to the ratio of the test signal amplitude to the recorded signal amplitude. The compensated audio signal will exhibit lower harmonic distortion (HD) and intermodulation distortion (IMD), which are the typical specifications for nonlinear distortion of a speaker.

Phase Plane Characterization

The test set-up for characterizing the memoryless non-linear distortion properties of the speaker and the method of generating the LUT are illustrated in FIGS. 2 through 5. The test set-up suitably includes a computer 10, a sound card 12, the speaker under test 14 and a microphone 16. The computer generates and passes a digital audio test signal 18 to sound card 12, which in turn drives the speaker. Microphone 16 picks up the audible signal and converts it back to an electrical signal. The sound card passes the recorded digital audio signal 20 back to the computer for analysis. A full duplex sound card is suitably used so that playback and recording of the test signal is performed with reference to a shared clock signal so that the digital signals are time-aligned to within a single sample period, and thus fully synchronized.

The techniques of the present invention will characterize and compensate for any memoryless source of non-linear distortion in the signal path from playback to recording. Accordingly, a high quality microphone is used such that any distortion induced by the microphone is negligible. Note, if the transducer under test were a microphone, a high quality speaker would be used to negate unwanted sources of distortion. To characterize only the speaker, the "listening environment" should be configured to minimize any reflections or other sources of distortion. Alternately, the same techniques can be used to characterize the speaker in the consumer's home theater, for example. In the latter case, the consumer's receiver or speaker system would have to be configured to perform the test, analyze the data and configure the speaker for playback.

Figure 3A:
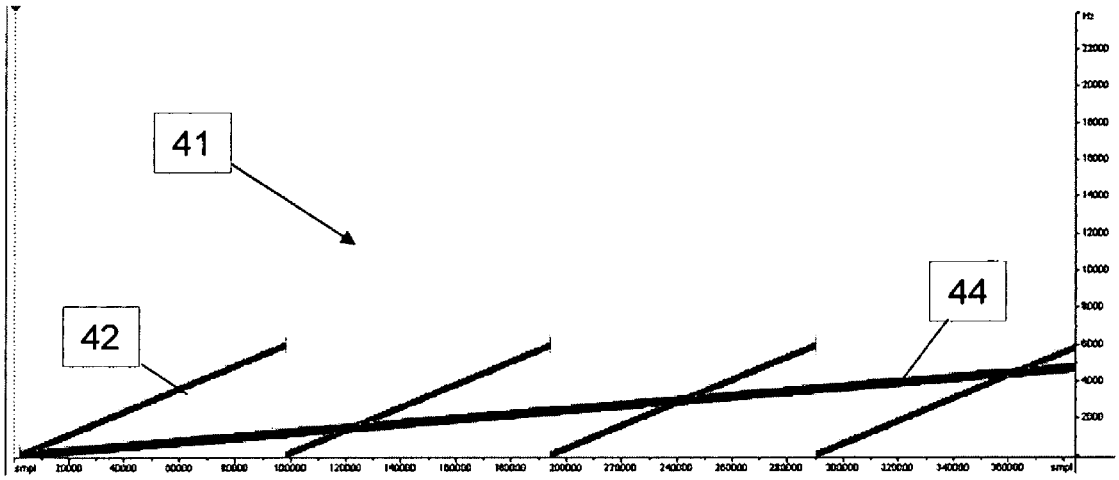
FIGS. 3*a*, 3*b*, 3*c* and 3*d* are plots of an exemplary test signal and its phase plane.
Figure 3B:
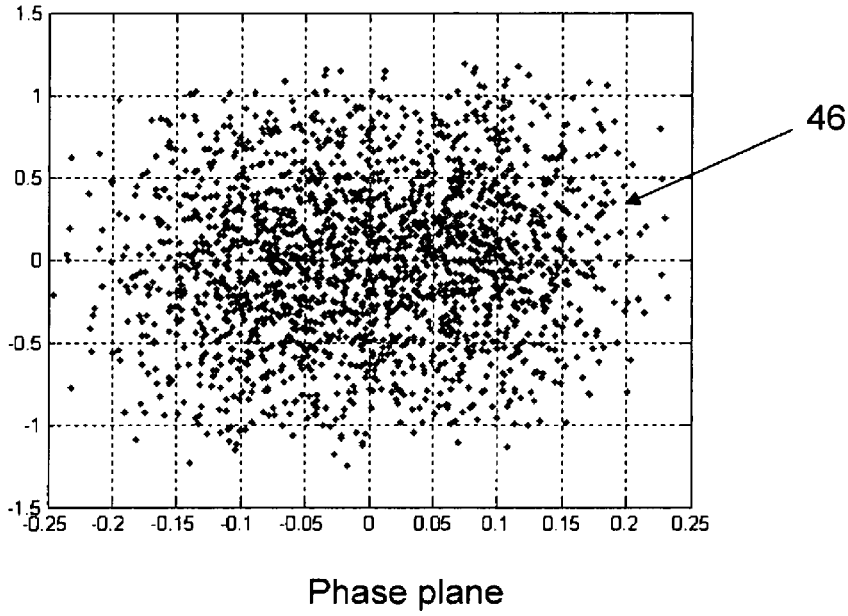
Figure 3C:
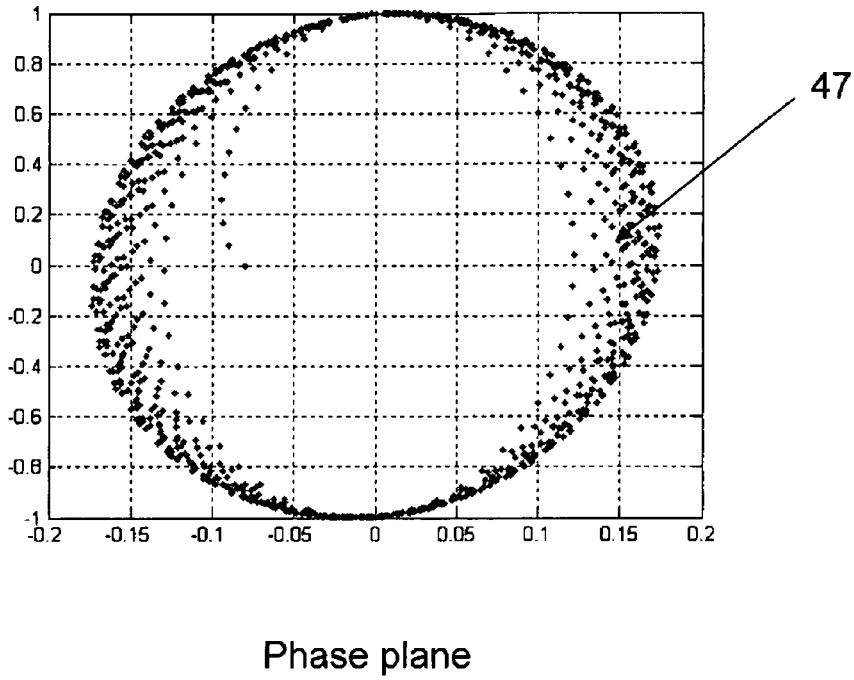
Figure 3D:
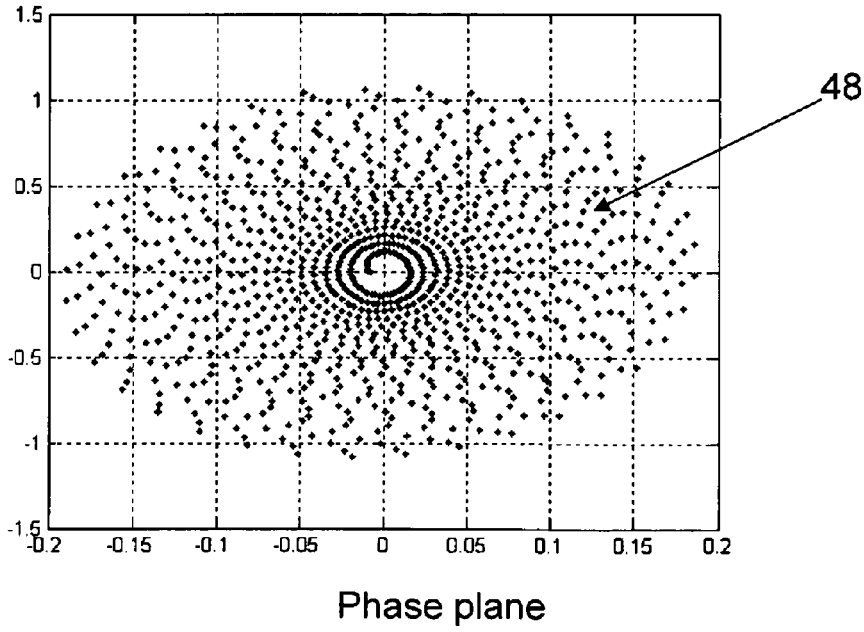

As described in FIG. 1*b*, to generate the LUT, the computer generates a test signal whose spectral content should cover phase plane i.e., the full range of signal amplitudes and velocities for the speaker (step 30). An exemplary text signal 41 consisting of two simultaneous sine waves 42 (0 to 6 kHz with amplitude of −6 db) and 44 (0 to 5 kHz with amplitude of −3 db) and the corresponding phase 46 are shown in FIGS. 3*a* and 3*b*, respectively. As shown, two sine waves with changing frequency and amplitude provide good coverage of the phase plane. FIG. 3*c* is the phase plane 47 for a single sine wave with increasing frequency, which provides no coverage at the center. FIG. 3*d* is the phase plane 48 for a single sine wave with changing amplitude and frequency, which provides better coverage but still not complete.

The computer then executes a synchronized playback and recording of the test signal (step 32). For each sample n, the computer calculates a scale factor as the ratio of the amplitude of test signal s(n) to the amplitude of the recorded signal r(n), e.g., SF=s(n)/r(n) (step 34). Alternately, SF(n)=log(s(n)/r(n)) in which case the LUT is logarithmic. A 'bias' constant may be added to the denominator r(n) to prevent division by 0 when r(n)=0 or to reduce the influence of noise. In either case, the only independent variables in the scale factor computation are computed are s(n) and r(n). The computer then calculates the velocity v(n) of test signal s(n) (step 36). This may be done analytically from equations used to generate the test signal or empirically from the test signals samples. The empirical calculation can be as simple as the change in amplitude from the previous to the current sample divided by the sampling interval, the change in amplitude from the previous to the succeeding sampled divided by twice the sampling interval or by calculating gradient through a 5- or 7-point FIR filter. For each sample, the scale factor is stored in a table with an index of (s(n),v(n)) (step 38). The scale factor represents the amount of memoryless non-linear distortion associated with the speaker when driven at a given signal amplitude and velocity.

The computer performs steps 34, 36 and 38 for each sample in the test signal and uses the data to construct a lookup table (LUT) of scale factors indexed by (s(n),v(n)) (step 39). If multiple scale factors are calculated for a given index (s(n),v(n)), the scale factors are averaged or filtered to assign a single value to the index. The scale factors may be interpolated and resampled to produce a table having a desired indexing e.g., uniform spacing along the amplitude and velocity axis, and values for every index. If the test signal does not quite span the range of amplitudes and velocities, the data can be extrapolated to assign those values. Alternately, these points may be assigned a value of one. The larger the amplitude and velocity ranges and/or the finer the resolution of the indexing, the larger the size of the LUT. The selection of these parameters will depend on the particular application.

In certain implementations, it may be desirable to approximate the LUT with a polynomial equation in which the only independent variables are the amplitude and velocity, e.g. SF=f(amplitude, velocity)(step 40). During playback, a polynomial evaluation may be preferred in systems with very strict requirements on memory footprint, e.g. the polynomial is much smaller than the LUT. Evaluation of the polynomial at playback may be slower or faster than the LUT depending on such factors as the number of terms in the polynomial and the interpolation algorithm used in conjunction with the LUT. Bilinear interpolation is quite fast while bicubic interpolation is somewhat slower. A standard 2D polynomial fitting algorithm can be used to find the proper order and coefficients of the polynomial.

Figure 4:
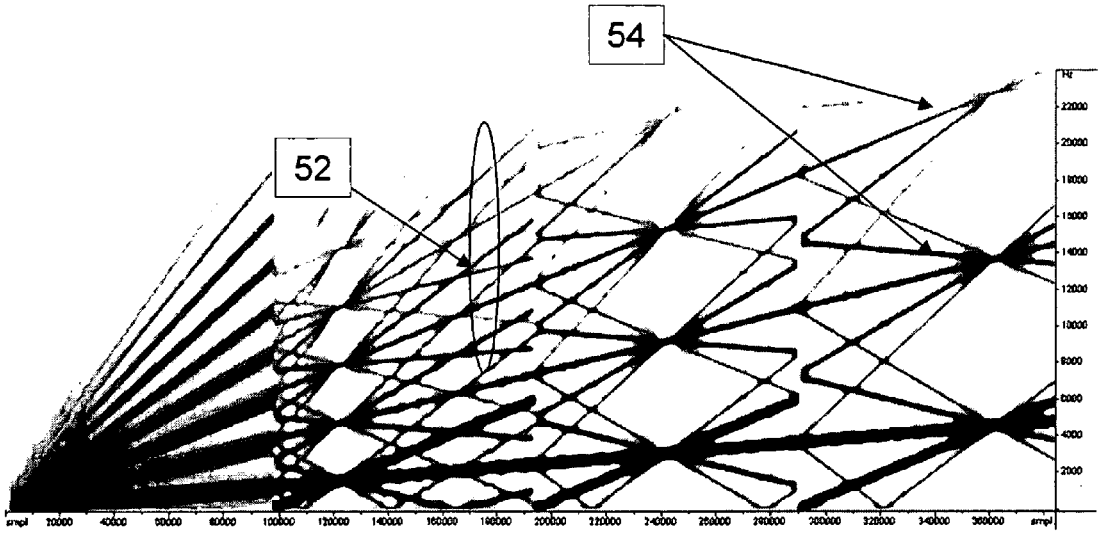
FIG. 4 is a plot of a recorded signal including HD and IMD of the speaker.

For an exemplary speaker, the spectral content 50 of the recorded signal for the test signal shown in FIG. 3*a* includes both IMD 52 and HD 54 in addition to the replicated test signal 41 as illustrated in FIG. 4. IMD and HD are the primary distortion values that are specified for a speaker or other audio transducer. Therefore, reducing IMD and HD are of primary importance.

Figure 5:
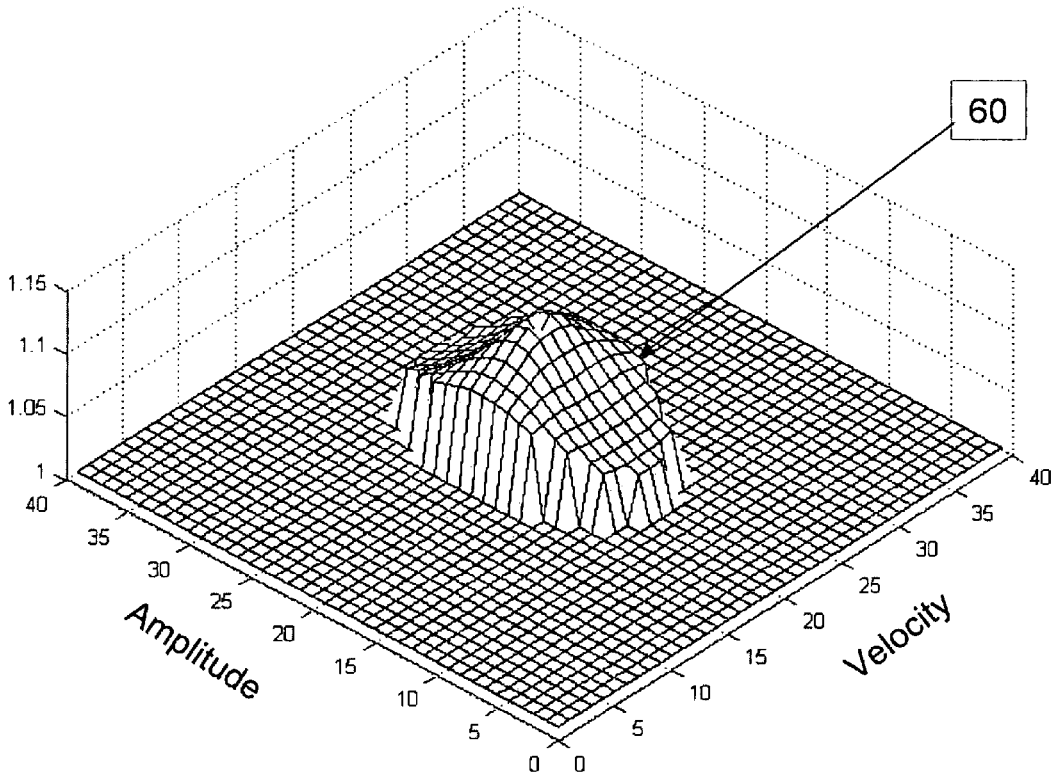
FIG. 5 is a diagram of the phase plane that is mapped to the LUT.

For the exemplary speaker and test signal, a phase-plane 60, i.e. the data for constructing the LUT, is illustrated in FIG. 5. The data can be interpolated and/or extrapolated and resampled to generate the LUT having a specified indexing and resolution. For this particular speaker, the distortion peaks near the mid-range of the amplitude and velocity and rolls off in all directions. Other speakers or audio transducers will have different properties and will exhibit different distortion.

The described approach is particularly applicable to earphones, where the full size of the earphone is smaller then (or comparable to) the wavelength (and therefore the system can be better approximated by momentary values). Assume an average earphone size is 1 cm and the highest audio frequency is 16 kHz. The wavelength of the 16 kHz sound wave in air is 330 m/sec/16 kHz=2 cm. Inside the earphone the sound waves will propagate faster than in air, but the wavelength of the highest frequency remains comparable to the earphone size. The time of wave propagation from one end of the system to the other can be approximated to be zero. Consequently the memory effects will be negligible.

Distortion Compensation and Reproduction

In order to compensate for the speaker's memoryless non-linear distortion characteristics, the audio data samples d(n) having amplitude a(n) must scaled prior to its playback through the speaker. This can be accomplished in a number of different hardware configurations, two of which are illustrated in FIGS. 6*a*-6*b*.

Figure 6A:
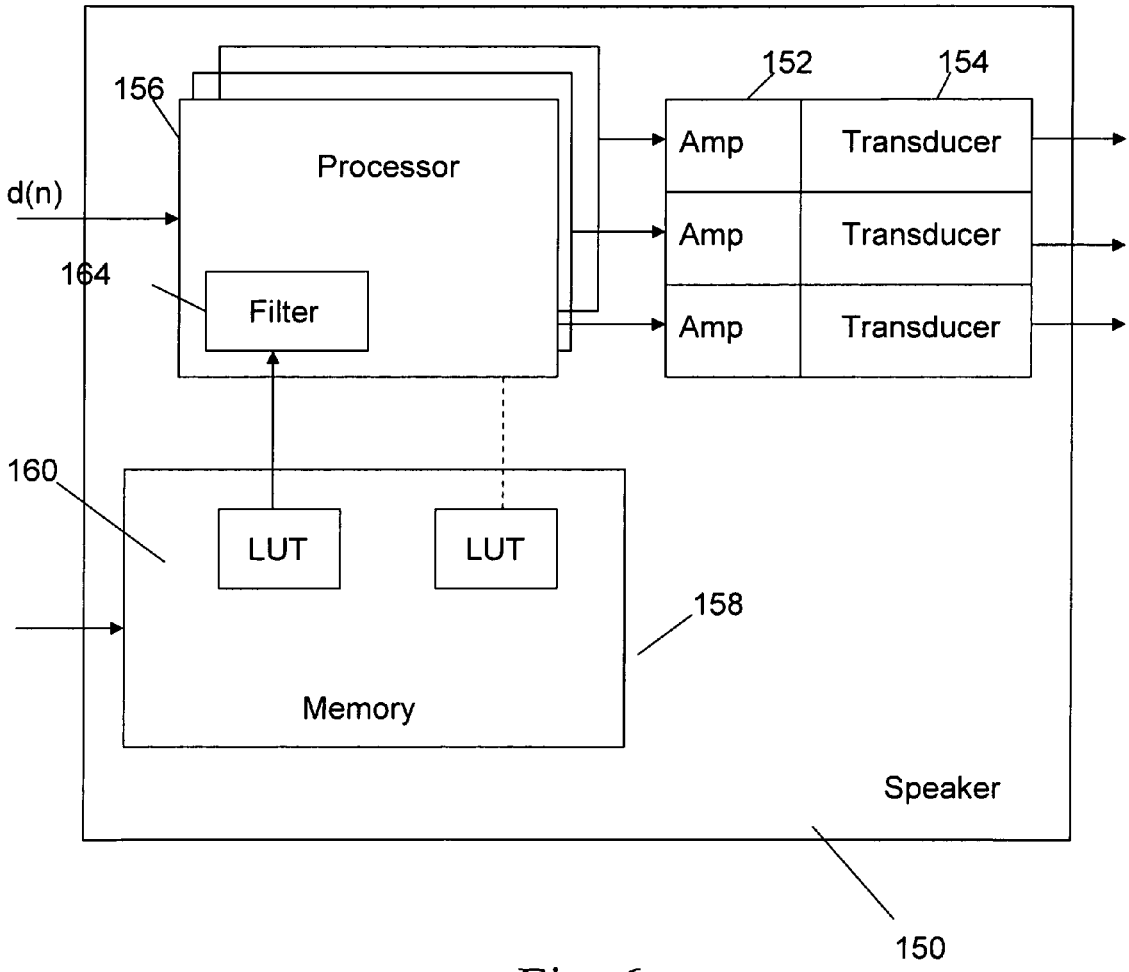
FIGS. 6*a* and 6*b* are block diagrams of an audio system configured to use the phase plane LUT to compensate non-linear distortion of the speaker.

As shown in FIG. 6*a*, a speaker 150 having three amplifier 152 and transducer 154 assemblies for bass, mid-range and high frequencies is also provided with the processing capability 156 and memory 158 to precompensate the input audio signal to cancel out or at least reduce memoryless non-linear speaker distortion. In a standard speaker, the audio signal is applied to a cross-over network that maps the audio signal to the bass, mid-range and high-frequency output transducers. In this exemplary embodiment, each of the bass, mid-range and high-frequency components of the speaker were individually characterized for their memoryless non-linear distortion properties. The LUT 160 is stored in memory 158 for each speaker component. The LUT can be stored in memory at the time of manufacture, as a service performed to characterize the particular speaker, or by the end-user by downloading them from a website and porting them into the memory. Processor(s) 156 executes a filter 164 that measures the signal amplitude a(n), computes the velocity v(n) and extracts the scale factor(s) closest to the index a(n), v(n). Filter 164 suitably interpolates the extracted scale factor(s) using, for example, a bilinear or bicubic algorithm to obtain the scale factor. Bilinear interpolation requires the four nearest scale factors whereas bicubic interpolation requires the sixteen nearest. The filter multiples the data sample d(n) by the scale factor. The scaled data samples d(n) are forwarded to the processor's D/A and than on to the amplifier 152.

Figure 6B:
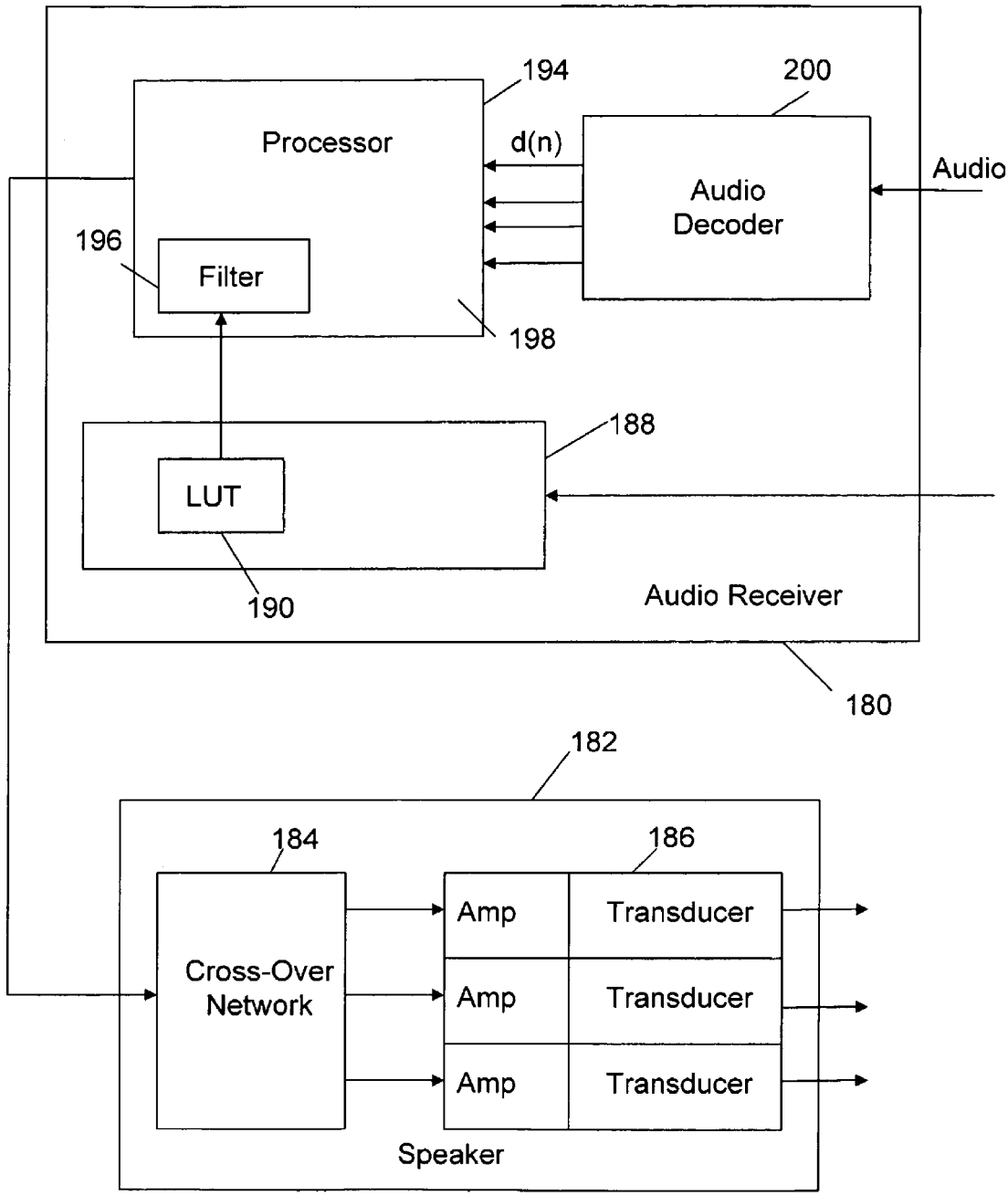

As shown in FIG. 6*b*, an audio receiver 180 can be configured to perform the precompensation for a conventional speaker 182 having a cross-over network 184 and amp/transducer components 186 for bass, mid-range and high frequencies. Although the memory 188 for storing the LUT 190 and the processor 194 for implementing the filter 196 are shown as separate or additional components for the audio decoder 200 it is quite feasible that this functionality would be designed into the audio decoder. The audio decoder receives the encoded audio signal from a TV broadcast or DVD, decodes it and separates into stereo (L,R) or multi-channel (L,R,C,Ls,Rs, LFE) channels which are directed to respective speakers. As shown, for each channel the processor applies the filter to the audio signal and directs the precompensated signal to the respective speaker 182. The filter performs in same manner as described above.

In an alternative embodiment, the speaker or application only requires that a low-frequency band be compensated. In this case, the audio samples d(n) can be downsampled to that low-frequency band, the filter applied to each sample and than upsampled to the full frequency band. This achieves the required compensation at a lower CPU load per sample.

Precompensation using the LUT will work for any output audio transducer such as the described speaker or headphones. However, in the case of any input transducer such as a microphone any compensation must be performed "post" transducing from an audible signal into an electrical signal, for example. The analysis for constructing the LUT changes slightly. The scale factors are indexed against the (amplitude, velocity) of the recorded signal instead of the test signal. The synthesis for reproduction or playback is very similar except that it occurs post-transduction.

Testing & Results

Figure 7:
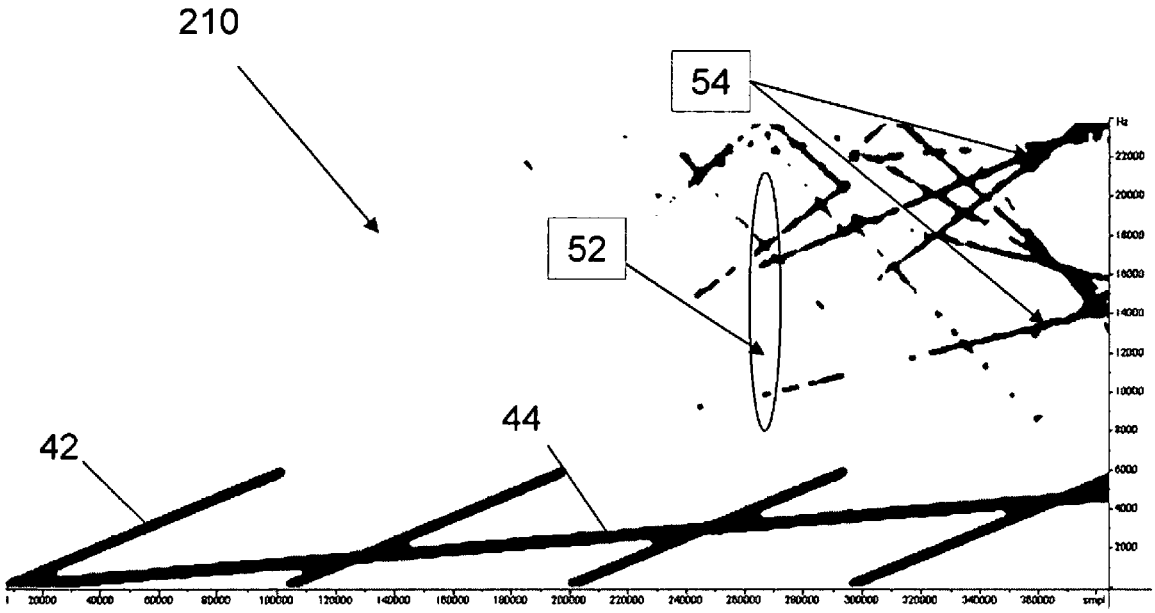
FIG. 7 is a diagram of the compensated recorded signal.

The general approach set-forth of characterizing and compensating for the memoryless non-linear distortion components is validated by the spectral response 210 of the output audio signal measured for a typical speaker as shown in FIG. 7. As shown, the input signal including the high and low frequency sine waves 42 and 44, respectfully are faithfully reproduced and the IMD 52 and HD 54 are heavily attenuated. The distortion compensation is not perfect because the energy equations for the system are only approximations, interpolation error in the scale factors and the presence of non-linear distortion having memory. However, the described solution for compensating memoryless non-linear distortion in an audio transducer is fast, cost-effective and highly effective.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

I claim:

1. A method of compensating digital audio samples d(n) of a digital audio signal for an audio transducer, comprising:

storing a lookup table (LUT) for the audio transducer in memory, said LUT including scale factors of the transducer's memoryless nonlinear distortion over a phase plane indexed by sample amplitude, velocity pairs, measuring an amplitude a(n) of the digital audio signal for each digital audio sample d(n);

estimating a velocity v(n) of the digital audio signal for each digital audio sample d(n);

for each digital audio sample d(n), using the amplitude, velocity pair (a(n),v(n)) to extract a scale factor from the LUT; and scaling the amplitude a(n) of each digital audio sample d(n) by the extracted scale factor.

2. The method of claim 1, wherein the amplitude a(n) of each said sample d(n) is scaled by one said extracted scale factor.

3. The method of claim 1, further comprising extracting a plurality of scale factors closest to the (a(n),v(n)) and performing an interpolation on said plurality to produce the scale factor for the measured (a(n),v(n)) pair.

4. The method of claim 1, wherein each scale factor is determined by ratio of the amplitude of a test signal s(n) applied to the audio transducer and the amplitude of a recorded signal r(n) reproduced by the audio transducer.

5. The method of claim 4, wherein said LUT is indexed by the amplitude, velocity pair of the test signal, said digital audio signal being scaled by the scale factor to pre-compensate the digital audio signal.

6. The method of claim 5, wherein the audio transducer is an earphone, further comprising:

playback of the pre-compensated digital audio signal on the earphone.

7. The method of claim 4, wherein said LUT is indexed by the amplitude, velocity pair of the recorded signal, said digital audio signal being scaled by the scale factor to post-compensate the audio signal.

8. The method of claim 1, wherein the digital audio samples d(n) are downsampled to a low-frequency band where the scale factor is extracted and the samples scaled and then upsampled to the full frequency band.

9. A method of compensating digital audio samples d(n) of a digital audio signal for an audio transducer, comprising:

measuring an amplitude a(n) of the digital audio signal for each digital audio sample d(n);

estimating a velocity v(n) of the digital audio signal for each digital audio sample d(n);

using the amplitude, velocity pair (a(n),v(n)) to extract a scale factor from a phase plane representation of the audio transducer, said phase plane representation embodying scale factors of the transducer's memoryless nonlinear distortion over the phase plane as a function of amplitude and velocity, wherein the phase plane representation is a polynomial equation whose only independent variables are the measured signal amplitude a(n) and signal velocity v(n); and scaling the amplitude a(n) of digital audio signal by the scale factor.

10. A system for compensating digital audio samples d(n) of a digital audio signal for an audio transducer, comprising:

memory for storing a lookup table (LUT) for the audio transducer, said LUT including scale factors of the transducer's memoryless nonlinear distortion over the phase plane indexed by sample amplitude, velocity pairs; and a processor that measures an amplitude a(n) of the digital audio signal each digital audio sample d(n), estimates a velocity v(n) of the digital signal for each digital audio sample d(n), extracts a scale factor from the LUT using the measured a(n), v(n) pair, and scales the amplitude a(n) of the digital audio sample d(n) by the scale factor.

11. The system of claim 10, wherein the processor scales the amplitude a(n) of each said sample d(n) by one said scale factor.

12. The system of claim 10, wherein the processor extracts a plurality of scale factors closest to the measured (a(n),v(n)) pair and performs an interpolation on said plurality to produce the scale factor for the measured (a(n),v(n)) pair.

13. The system of claim 10, wherein each scale factor is determined by a ratio of the amplitude of a test signal s(n) applied to the audio transducer and the amplitude of a recorded signal r(n) reproduced by the audio transducer.

14. The system of claim 13, wherein said LUT is indexed by the amplitude, velocity pair of the test signal, said digital audio signal being scaled by the scale factor to pre-compensate the audio signal.

15. The system of claim 14, wherein the audio transducer is an earphone, said processor directing the pre-compensated digital audio signal for playback on the earphone.

16. The system of claim 13, wherein said LUT is indexed by the amplitude, velocity pair of the recorded signal, said digital audio signal being scaled by the scale factor to post-compensate the audio signal.

17. The system of claim 10, wherein the processor downsamples the digital audio samples d(n) to a low-frequency band where the scale factor is extracted and the samples scaled and then up samples the scaled samples to the full frequency band.

18. A system for compensating digital audio samples d(n) of a digital audio signal for an audio transducer, comprising:

memory for storing a phase plane representation of the audio transducer, said phase plane representation embodying scale factors of the transducer's memoryless nonlinear distortion over the phase plane as a function of amplitude and velocity, wherein the phase plane representation is a polynomial equation whose only independent variables are the measured signal amplitude and signal velocity; and a processor that measures an amplitude a(n) of the digital audio signal for each digital audio sample d(n), estimates a velocity v(n) of the digital audio signal for each digital audio sample d(n), extracts a scale factor from the phase plane representation using the measured a(n), v(n) pair, and scales the amplitude a(n) of the digital audio signal by the scale factor.

19. A method of determining a phase plane representation of scale factors for compensating memoryless nonlinear distortion of an audio transducer, comprising:

synchronized playback and recording of a test signal through the audio transducer; and storing a ratio of the test signal amplitude s(n) to the recorded signal amplitude r(n) as a scale factor in a lookup table (LUT) indexed by a signal amplitude, signal velocity pair.

20. The method of claim 19, wherein the amplitude and velocity of the test signal spans at least a desired range of the phase plane.

21. The method of claim 20, wherein the test signal comprises first and second sine waves with changing frequency and amplitude.

22. The method of claim 19, further comprising extrapolating the scale factors in the LUT to cover the entire phase plane.

23. The method of claim of claim 19, further comprising interpolating and resembling the scale factor in the LUT to a desired amplitude, velocity indexing.

24. The method of claim 19, wherein the LUT is indexed by the amplitude, velocity pair of the test signal for use in pre-compensating an audio signal for playback on an audio transducer.

25. The method of claim 19, wherein the LUT is indexed by the amplitude, velocity pair of the recorded signal for use in post-compensating an audio signal reconstructed from an audio transducer.

26. The method of claim 19, further comprising:

approximating the LUT with a polynomial equation whose only independent variables are the signal amplitude and signal velocity.

* * * * *